US006523508B2

(12) United States Patent
Hüsges et al.

(10) Patent No.: US 6,523,508 B2
(45) Date of Patent: Feb. 25, 2003

(54) MANUALLY GUIDED IMPLEMENT

(75) Inventors: Markus Hüsges, Bad Wiessee (DE); Gerhard Stoll, Winnenden (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 09/849,128

(22) Filed: May 4, 2001

(65) Prior Publication Data

US 2001/0037776 A1 Nov. 8, 2001

(30) Foreign Application Priority Data

May 4, 2000 (DE) ..... 100 21 705

(51) Int. Cl.[7] ..... F01P 7/04
(52) U.S. Cl. ..... 123/41.65
(58) Field of Search ..... 123/41.56, 41.65, 123/41.7

(56) References Cited

U.S. PATENT DOCUMENTS 4,841,929 A * 6/1989 Tuggle et al. ..... 123/198 E
5,383,427 A * 1/1995 Tuggle et al. ..... 123/195 R
6,314,922 B1 * 11/2001 Zimmermann et al. .. 123/41.56

FOREIGN PATENT DOCUMENTS

WO WO 99/45243 5/1999

* cited by examiner

*Primary Examiner*—Noah P. Kamen
(74) *Attorney, Agent, or Firm*—R. W. Becker & Associates; R. W. Becker

(57) ABSTRACT

A manually guided implement having an air-cooled internal combustion engine for driving a tool is provided. Disposed between an output shaft of the internal combustion engine and the tool is a centrifugal clutch, whereby a flywheel portion of the clutch and a fan wheel are fixedly disposed on the output shaft. The flywheel portion is secured on a suction side of the fan wheel that is provided with guide vanes.

9 Claims, 4 Drawing Sheets

MANUALLY GUIDED IMPLEMENT

BACKGROUND OF THE INVENTION

The present invention relates to a manually guided implement, such as a brush cutter, power chain saw, or the like, that has an air-cooled internal combustion engine for driving a tool.

WO 99/45243 discloses a portable brush cutter for mowing grass, and has an air-cooled internal combustion engine that drives the cutting tool with its crankshaft. Between the crankshaft of the internal combustion engine and the tool is a centrifugal clutch that below certain engine speeds separates the drive mechanism via the engine from the tool. Fixedly held on the crankshaft is the flywheel portion of the centrifugal clutch, whereby the centrifugal bodies deflect under the influence of centrifugal forces when certain speeds are exceeded, whereby the centrifugal bodies close the clutch and the torque of the engine is transferred through the tool.

To cool the internal combustion engine, a fan wheel is fixedly held on the crankshaft and carries, on that suction side that faces away from the internal combustion engine, a suction ring of vanes having a plurality of guide vanes. The fan wheel, by means of its suction ring of vanes, conveys cooling air that surrounds the implement to the internal combustion engine. In this connection, the cooling air is drawn in from the direction of the centrifugal clutch that is secured to the end of the driver of the crankshaft. The flywheel portion is fixedly connected with the crankshaft, as a result of which transfer of the torque to the tool is ensured via the centrifugal clutch. The fan wheel is secured through the driver of the crankshaft between the flywheel portion and the internal combustion engine.

It is therefore an object of the present invention to improve an implement of the aforementioned general type in such a way that the overall size and weight of the implement are reduced, thereby improving the portability of the implement.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
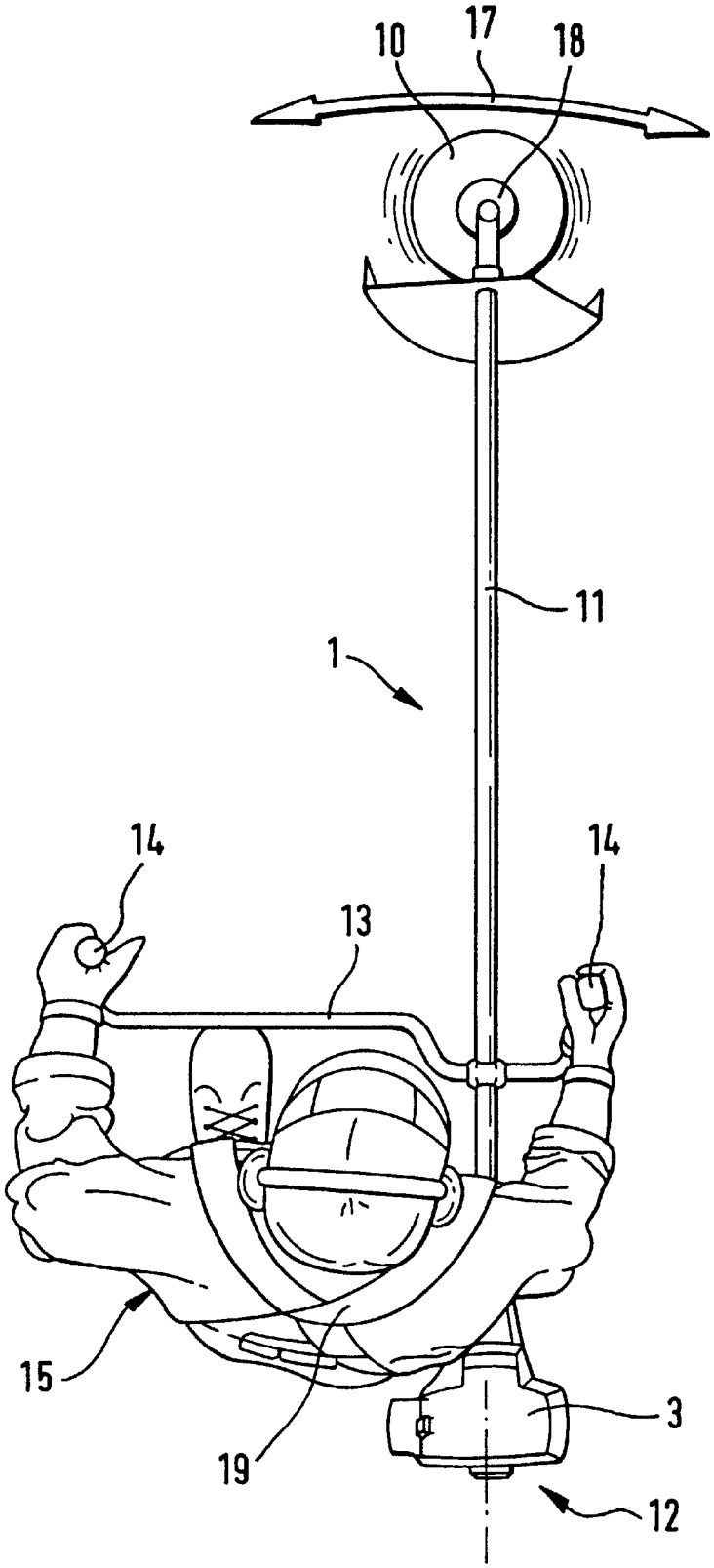
FIG. 1 is a plan view of a brush cutter.

The manually guided implement of the present invention is characterized primarily in that the flywheel portion of the centrifugal clutch is secured to the suction side of the fan wheel, which is provided with guide vanes.

With portable implements, where the fan wheel is disposed on the output shaft of the internal combustion engine, it is possible pursuant to the present invention to achieve a reduction of the overall size of the drive unit of the implement if the flywheel portion of the centrifugal clutch is secured to the suction side of the fan wheel, which is provided with guide vanes. The flywheel portion is connected to the output shaft in a torque transferring manner by means of its fixed connection with the fan wheel. The coupling part that is required with heretofore known arrangements between the output shaft and the flywheel portion can be eliminated, so that a reduction in weight and in the number of parts, and hence a reduction in the manufacturing costs for the implement, are provided. Furthermore, the output shaft, for example the crankshaft of the internal combustion engine, can be made shorter since it is necessary pursuant to the present invention to secure only the fan wheel on the shaft driver.

Expediently formed on the fan wheel are axially extending support rods, the free ends of which preferably extend at least to the height of the guide vanes and rest against the flywheel portion, although this can also be shorter. In this connection, the flywheel portion is fixedly connected with at least one of the support rods, whereby a connection of the flywheel portion to a number of support rods reinforces a transfer of the torque. The support rods can be monolithically formed on a base member of the fan wheel that carries the guide vanes, whereby there is practically no adverse effect upon the fan action of the guide vanes. Pursuant to one advantageous specific embodiment of the present invention, two or more support rods, which are grouped about an axis of rotation of the fan, are respectively provided with an axial bore in which the flywheel portion is held by means of appropriate connecting elements. Such connecting elements are expediently the swivel bolts of the flywheel portion upon which the centrifugal bodies are mounted in such a way that they can deflect. The free ends of the connecting bolts can be received and secured in the bores of the support rods. For this purpose, the free ends of the swivel bolts can be provided with a thread so that they can be screwed into the bores of the support rods.

The inventive connection of the flywheel portion to the fan wheel is advantageous not only for securement on the suction ring of vanes of fans having vanes on only one side. In particular, by connecting the flywheel portion to the side which is provided with vanes it is also possible to provide on that end face disposed remote from the suction side a second ring of vanes on the fan wheel, as a result of which two separate air streams can be conveyed with the fan wheel. The suction ring of vanes connected with the clutch portion, and a ring of vanes on the back side of the fan wheel, are expediently separated from one another by a partition that is radially formed on the fan wheel, as a result of which the design of two independent air streams is enhanced.

Further specific features of the present invention will be described in detail subsequently.

DESCRIPTION OF PREFERRED EMBODIMENTS

Referring now to the drawings in detail, the manually guided implement illustrated in FIG. 1 is a brush cutter 1 for mowing grass and other ground cover. It includes a guide rod 11 on which is disposed a steering or handle bar 13, which has handles 14 on the ends thereof, for guiding and operating the brush cutter 1. The brush cutter is carried by the operator 15 by means of a carrying strap 19, and is freely guided via the steering bar 13.

Disposed at the rear end of the guide rod 11 is a drive unit 12, in the housing 3 of which is accommodated an internal combustion engine 2. The internal combustion engine, by means of a drive shaft 16 that is mounted in the tubular guide rod 11, drives, by means of a miter gear 18, a tool 10 that is disposed at the front end of the guide rod 11. In the illustrated embodiment, the tool 10 is a cutter blade, which is moved back and forth over the surface that is to be mowed in the direction of the arrow 17 by the operator 15.

Figure 2:
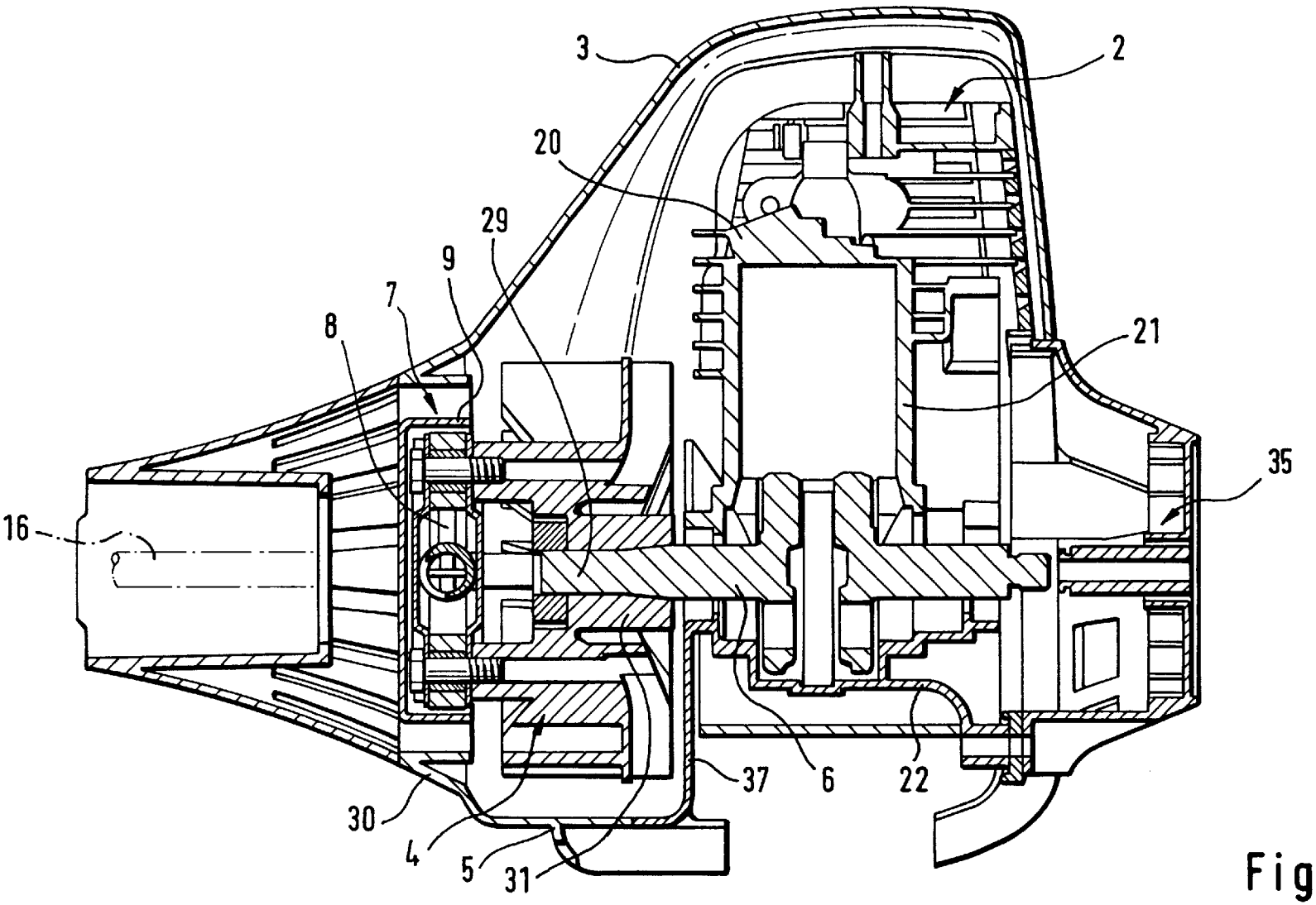
FIG. 2 is a longitudinal cross-sectional view of the drive unit of the brush cutter of FIG. 1.
Figure 3:
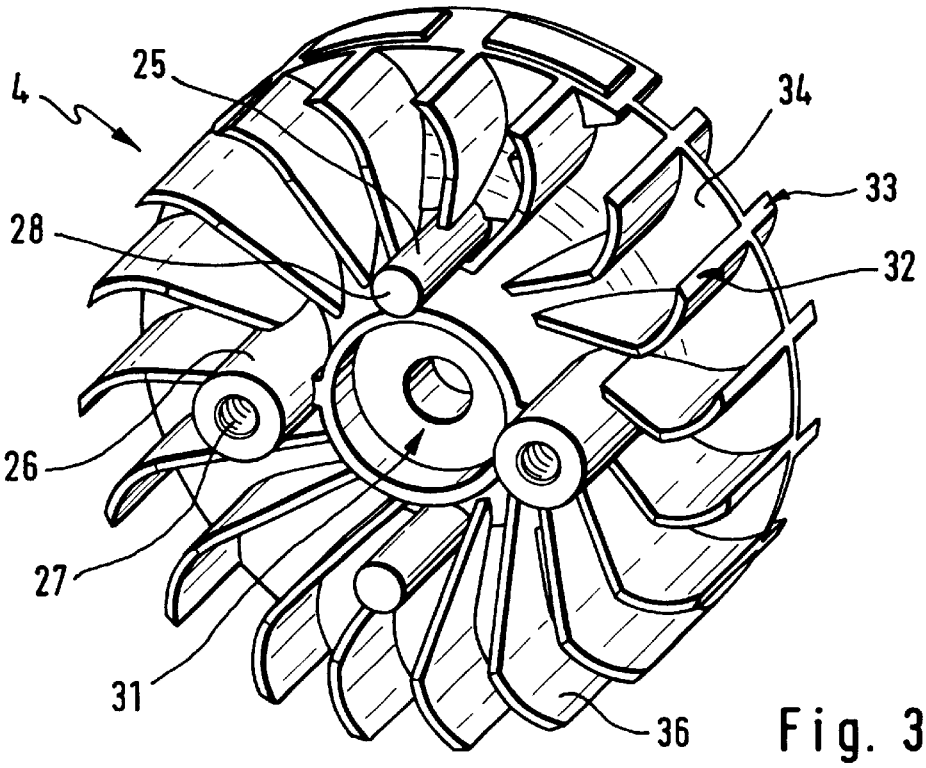
FIGS. 3 & 4 are perspective views of the fan wheel.
Figure 4:
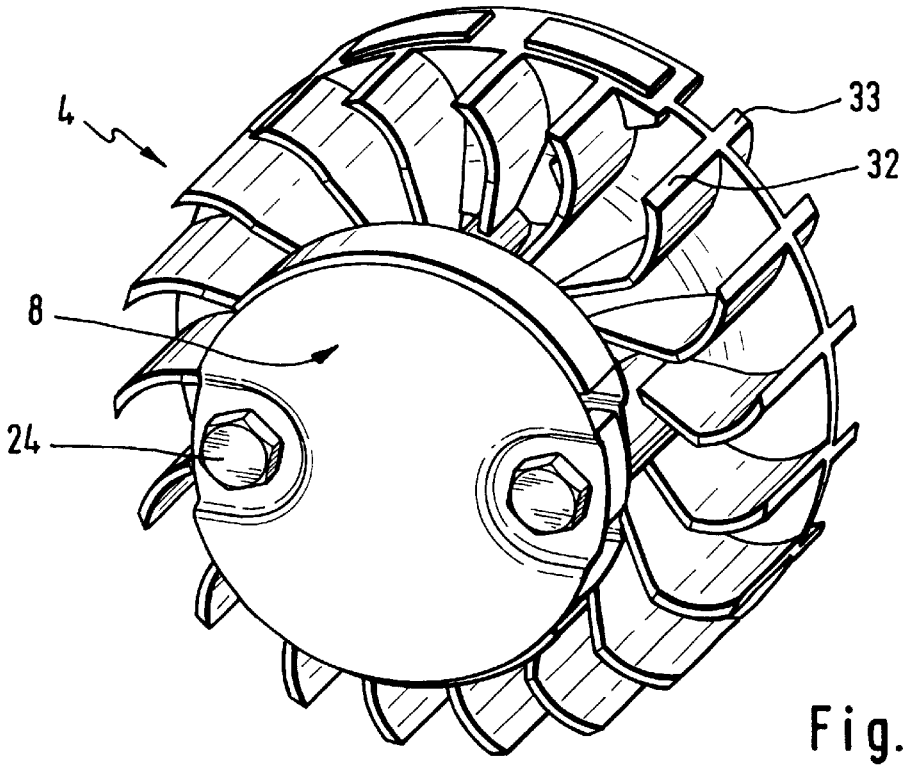
Figure 5:
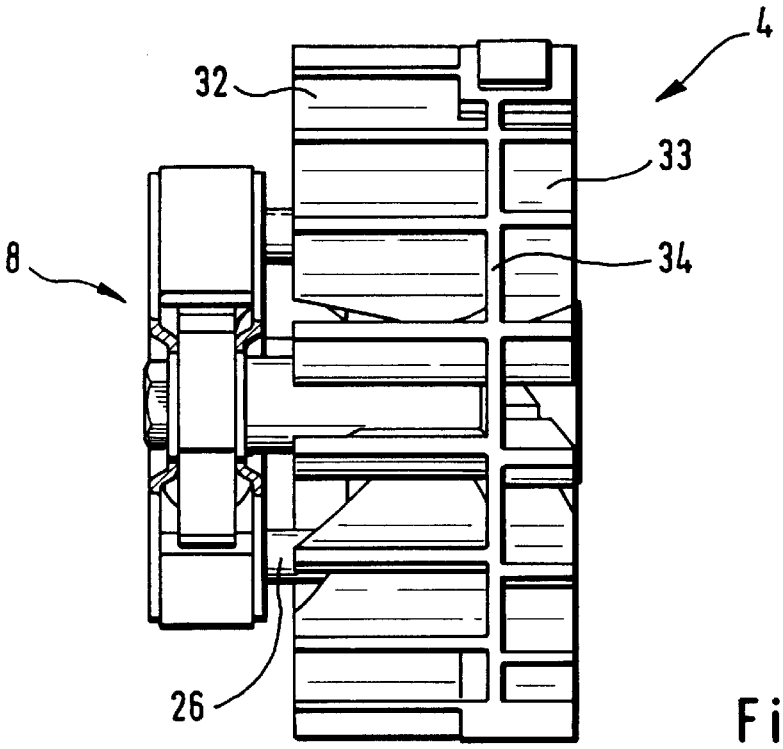
FIG. 5 is a side view of the fan wheel with an attached flywheel.
Figure 6:
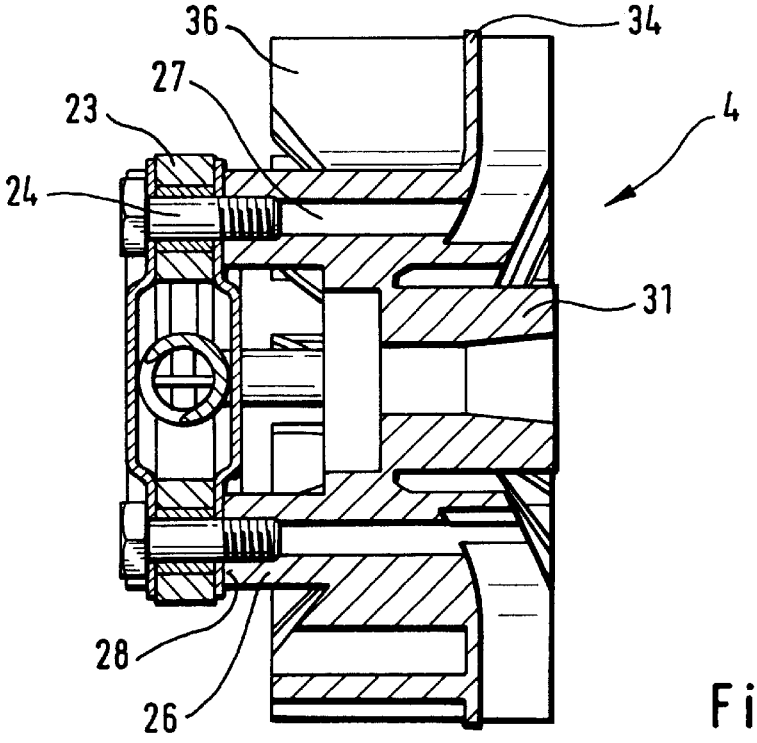
FIG. 6 is a cross-sectional view through the fan wheel.

The longitudinal cross-sectional view of the housing 3 of the drive unit 12 of the brush cutter 1 is shown in FIG. 2 in a sectional plane that contains the crankshaft 6 of the internal combustion engine 2. The internal combustion engine is a single cylinder engine, with the cylinder 21 and its cylinder head 20 being cooled by an air stream that is conveyed by a fan wheel 4. This fan wheel is fixedly held on a driver 29 of the crankshaft 6, and is accommodated in a cooling air spiral case 5 that is open toward the internal combustion engine 2. The cooling air spiral case has a cup-shaped configuration, and includes a base 37 that faces the internal combustion engine, and a peripheral wall along which the drawn-in cooling air stream is conveyed toward the cylinder head 20. In this way, the dirt particle fraction of the drawn-in cooling air is separated off.

A centrifugal clutch 7 is disposed between the crankshaft 6 of the internal combustion engine 2, which in the illustrated embodiment is the output shaft to the tool, and a drive shaft 16, which acts upon the cutter blade of the brush cutter. The centrifugal clutch 7 essentially comprises a flywheel portion 8, which is constantly driven by the crankshaft 6, and a coaxially disposed clutch housing 9 that extends axially over the flywheel portion 8. The clutch housing 9 is rigidly connected with the drive shaft 16, 6which is mounted in the tubular guide rod 11 (FIG. 1) of the brush cutter 1. At higher speeds of the crankshaft 6, and hence at the centrifugal forces acting upon the flywheel portion 8, the pivotably mounted flywheel bodies are deflected and come to rest against the inner side of the clutch housing 9, whereby the clutch is frictionally closed and the torque of the internal combustion engine 2 is transferred to the drive shaft 16. During idling operation of the internal combustion engine 2, the centrifugal clutch 7 separates the crankshaft 6 from the drive shaft 16 and hence from the cutter blade 10, which then stops turning.

The crankshaft 6 is mounted in a crankcase housing 22 of the internal combustion engine 2, and in the illustrated embodiment projects from both sides of the crankcase housing 22. As indicated previously, the fan wheel 4 is secured to the driver 29, while a rope pull starter mechanism 35 cooperates with the rear shaft journal of the crankshaft 6 that is disposed remote from the drive side. The fan wheel 4 draws in cooling air in essentially an axial direction through inlet slots disposed in a fan cover 30, which closes off an open end face of the cooling air spiral case 5 that is disposed remote from the base 37 of the spiral case. The fan cover 30 is in the shape of a pot that flares in the manner of a funnel and accommodates the centrifugal clutch 7. The diameter of the fan wheel 4 is greater than the diameter of the centrifugal clutch 7. The centrifugal clutch is thereby swept over and kept cool by the cooling air steam that is drawn in through the fan cover 30.

In the illustrated embodiment, the fan wheel 4 has a double flow configuration and carries on both end faces a respective ring of vanes (FIGS. 3–6). With the second set of vanes, a second air stream, which is separate from the cooling air stream, can be conveyed, and can, for example, either be withdrawn through an opening in the base 37 of the cooling air spiral case 5, or can be supplied to the spiral case 5.

Pursuant to the present invention, the flywheel portion 8 of the centrifugal clutch 7 is secured on the suction side of the fan wheel 4, which is provided with guide vanes, and forms a unit with the fan wheel 4 that is fixedly mounted together on the driver 29 with the hub 31 of the fan wheel 4. The transfer of the torque of the internal combustion engine 2 to the flywheel portion 8 is effected via the hub 31 of the fan wheel 4. A fixed connection of the flywheel portion 8 on the crankshaft 6 is not necessary; the coupling part necessary with heretofore known centrifugal clutches for the flywheel portion 8 can therefore be eliminated, and the driver 29 of the crankshaft 6 can be made shorter. The overall weight of the drive unit is thereby reduced, and a cost reduction of the implement can be achieved due to the reduction of the number of components and the shortening of the crankshaft, which normally are made of high grade and hence expensive material.

The fan wheel 4, on the suction side of which the flywheel portion 8 of the centrifugal clutch 7 is secured in a torque transferring manner, will be described in greater detail with the aid of FIGS. 3–6. On both end faces, the fan wheel 4 carries a respective ring of vanes 32,33, each having a plurality of guide vanes 36. The rings of vanes 32,33 are separated by a radially extending partition 34, the base of which is connected to the hub 31 of the fan wheel 4. By means of the partition 34, each ring of vanes 32,34 conveys an air stream independently of the other ring. On the outwardly disposed side of the fan wheel 4 in the installed state, i.e. on the side facing away from the internal combustion engine, the suction ring of vanes 32 is embodied for conveying the cooling air through the fan cover 30. In this connection, in the illustrated embodiment the suction ring of vanes 32 has a greater axial width than does the fan ring 33 on the back side of the fan wheel 4, and permits cooling air to be conveyed from the atmosphere around the implement with a large mass flow.

Formed on the fan wheel 4 are axially extending support rods 25,26, the free ends 28 of which can extend beyond the axial height of the guide vanes 36 and against which the flywheel portion 8 rests. In this connection, the flywheel portion 8 is secured to some of the support rods 25,26. In the illustrated embodiment, four support rods 25,26 are uniformly grouped about the axis of rotation and the hub 31 of the fan wheel 4. To secure the flywheel portion 8, two of the support rods are embodied as threaded rods 26 that are provided with a bore 27 in which the flywheel portion 8 is secured. The fastening elements for the flywheel portion 8 are in the form of swivel bolts 24 on which the centrifugal body 23 (FIG. 6) is pivotably mounted. In this connection, the swivel bolts 24 extend into the bores 27 and their bolt heads hold the flywheel portion 8 tightly against the free ends 28 of the support rods 25,26.

In the illustrated embodiment of a centrifugal clutch having two centrifugal bodies 23, in conformity therewith two swivel bolts 24 are provided on the flywheel portion 8. In this connection, the swivel bolts 24 are disposed diametrically across from one another, and the support rods 26 are correspondingly formed on the fan wheel 4. With centrifugal clutches having more than two centrifugal bodies, a number of support rods 26 corresponding to the number of centrifugal bodies are provided, and are grouped about the hub 31 of the fan wheel 4 in the rotational angle position of the associated swivel bolts 24.

The inventive fan wheel is monolithically formed, for example as an injection molded part, with the support rods for the securement of the flywheel portion 8 of the centrifugal clutch 7. The connection of the flywheel portion 8 to the fan wheel can be effected not only as in the illustrated embodiment for double flow fan wheels, but also for single flow fan wheels where the clutch is secured to the suction ring of vanes of the suction side.

The specification incorporates by reference the disclosure of German priority document 100 21705.2 of May 4, 2000.

The present invention is, of course, in no way restricted to the specific disclosure of the specification and drawings, but also encompasses any modifications within the scope of the appended claims.

What we claim is:

1. A manually guided implement having an air-cooled internal combustion engine for driving a tool, said implement comprising:

a centrifugal clutch disposed between said tool and an output shaft of said internal combustion engine, wherein said centrifugal clutch is provided with a flywheel portion; and a fan wheel for conveying air cooling to said internal combustion engine, wherein said fan wheel is non-rotatably supported with said flywheel portion as a unit on said output shaft, wherein on a suction side that faces away from said internal combustion engine said fan wheel is provided with a first suction ring of vanes, which is provided with a plurality of guide vanes, and wherein said flywheel portion of said centrifugal clutch is secured to said suction side of said fan wheel.

2. An implement according to claim 1, wherein axially extending support rods are formed on said fan wheel, wherein free ends of said support rods extend to less than, the same as, or beyond a height of said guide vanes and rest against said flywheel portion, and wherein said flywheel portion is axially fixedly connected with at least one of said support rods.

3. An implement according to claim 2, wherein said fan wheel has a base body that carries said guide vanes, and wherein said support rods are monolithically formed on said base body.

4. An implement according to claim 2, wherein at least two of said support rods, which are grouped about an axis of rotation of said fan wheel, are each provided with an axial bore in which said fly portion is held by means of connecting elements.

5. An implement according to claim 4, wherein said connecting elements are swivel bolts of said flywheel portion upon which centrifugal bodies of said centrifugal clutch are mounted in such a way as to be able to deflect, and wherein said swivel bolts are received and secured in said bores of said support rods.

6. An implement according to claim 1, wherein on an end face that is disposed opposite said suction side, said fan wheel is provided with a second ring of vanes.

7. An implement according to claim 6, wherein a radially extending partition is formed on said fan wheel and separates said second ring of vanes from said first suction ring of vanes.

8. An implement according to claim 1, wherein said fan wheel is a one-piece cast part.

9. An implement according to claim 1, wherein said fan wheel has a larger diameter than does said centrifugal clutch.

* * * * *